US009114057B1

(12) United States Patent
Padilla

(10) Patent No.: US 9,114,057 B1
(45) Date of Patent: Aug. 25, 2015

(54) MASTURBATORY GLOVE

(76) Inventor: Maxx A. Padilla, Sherman Oaks, CA (US)

( * ) Notice: Subject to any disclaimer, the term of this patent is extended or adjusted under 35 U.S.C. 154(b) by 561 days.

(21) Appl. No.: 13/423,336

(22) Filed: Mar. 19, 2012

Related U.S. Application Data

(60) Provisional application No. 61/468,536, filed on Mar. 28, 2011.

(51) Int. Cl.
*A61H 19/00* (2006.01)

(52) U.S. Cl.
CPC ..... *A61H 19/32* (2013.01); *A61H 2205/087* (2013.01)

(58) Field of Classification Search
CPC ..... A61H 19/44; A61H 19/34; A61H 2201/0153; A61H 19/32; A61H 19/50; A61H 19/00; A61H 23/00
USPC ..... 600/38–40
See application file for complete search history.

(56) References Cited

U.S. PATENT DOCUMENTS

| | | | | |
|---|---|---|---|---|
| 1,552,080 | A | 9/1925 | Rainey | |
| 2,004,684 | A | 6/1935 | Bell | |
| 6,513,998 | B1 * | 2/2003 | Barry | 401/7 |
| 6,578,205 | B1 | 6/2003 | King | |
| 6,656,139 | B2 | 12/2003 | Zwezdaryk | |
| 6,749,557 | B2 | 6/2004 | Garland | |
| 6,849,041 | B2 | 2/2005 | Astin | |
| 7,159,246 | B2 * | 1/2007 | Tippey | 2/163 |
| 7,163,508 | B1 | 1/2007 | Washington | |
| 7,179,415 | B2 | 2/2007 | Teoh et al. | |
| 2005/0072374 | A1 * | 4/2005 | Claire | 119/652 |
| 2009/0158498 | A1 | 6/2009 | Singer | |
| 2011/0010822 | A1 * | 1/2011 | Singer | 2/161.7 |
| 2013/0245366 | A1 | 9/2013 | Rhodes | |

FOREIGN PATENT DOCUMENTS

WO 2009066281 A2 5/2009

OTHER PUBLICATIONS

Adam and Eve webpage, Pleasure Pearl [online]. Retrieved from the Internet on Mar. 8, 2012 <URL:www.adameve.com/adult-sex-toys/male-masturbators/sp-adam-evepleasure-pearl-masturbator-10458.aspx>.

California Exotic Novelties webpage, Jac Off Masturbator [online]. Retrieved from the Internet on Mar. 8, 2012 <URL:www.calexotics.com/p-22531-jac-off-masturbator.aspx>.

(Continued)

*Primary Examiner* — Christine H Matthews
(74) *Attorney, Agent, or Firm* — CreatiVenture Law, LLC; Dennis JM Donahue, III

(57) ABSTRACT

A masturbatory glove has a soft elastomeric gel coating or silicone on its palm that simulates the inside of a woman's vagina. The glove has a built-in, pressure-activated self-lubricating system which allows a lubricant to be inserted into a pouch on the glove and then be dispensed through orifices directly onto the palm side of the glove when pressure is applied to the pouch. The glove has a vibrator in a pocket located on the inside palm of the glove or on the little finger of the glove. A ridge is formed along the inner edge of the forefinger and thumb portions of the glove, and the ridge holds the lip of a bodily fluid catcher.

32 Claims, 8 Drawing Sheets

(56) References Cited

OTHER PUBLICATIONS

Drugstore.com webpage, Fukuoku Massage Glove [online]. Retrieved from the Internet on Mar. 8, 2012 <URL:www.drugstore.com/fukuoku-five-finger-waterproof-massageglove-right-hand/qxp81304>.

Eden Fantasys webpage, Love Glove [online]. Retrieved from the Internet on Mar. 8, 2012 <URL:www.edenfantasys.com/masturbators/masturbation-sleeves/tube-love-glove>.

* cited by examiner

MASTURBATORY GLOVE

CROSS-REFERENCE TO RELATED APPLICATIONS

This application claims priority to U.S. Provisional Patent Application Ser. No. 61/468536 filed on Mar. 28, 2011 and titled "MASTURBATORY GLOVE", which is herein incorporated in its entirety.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to sex toys and more particularly to a masturbatory glove that simulates the feel of a woman's vagina and includes a lubrication dispensing system within the glove.

2. Related Art

There are male masturbatory sex toys on the market that are formed form a simple tube structure with which the user engages in intercourse, such as ADAM & EVE'S PLEASURE PEARL or the LOVE GLOVE. Such tubes may simply be formed from a silicone tube with an inner texture used for masturbation, and some models may include vibration. There is also the FOKUOKU Massage Glove that is a vibrating glove. However, this massage glove is intended for massage and not for masturbation so it lacks a soft silicone/gelatin texture that is beneficial for a masturbatory glove. The JAC-OFF product is silicone textured pad used for masturbating, but it is simply a textured pad the user holds in their hand while masturbating, and does not have the features of the inventive glove described below.

SUMMARY OF THE INVENTION

The present invention is a masturbatory glove having a palm side including a plurality of openings and a pouch in fluid communication with the openings. The palm side of the glove may include a spandex layer and an elastomeric gel layer joined to the spandex layer. The elastomeric gel layer may be molded directly to the spandex layer or attached with an adhesive. The elastomeric gel may be a thermoplastic elastomer gel and/or any other suitable gel. Alternatively, the palm side of the glove may include a spandex layer and a silicone layer, wherein the silicone layer is molded directly to the spandex layer or joined to the spandex layer by an adhesive.

The pouch holds a lubricant and is pressure activated to dispense the lubricant through the openings onto the palm side of the glove. In particular, a plurality of tubes extend between the pouch and the openings. The pouch is formed on the back side of the glove and the tubes extend to the openings on the palm side of the glove. The pouch may include a bladder retained therein to hold the lubricant. The bladder is in fluid communication with the openings via the plurality of tubes and includes a plug for inserting lubricant therein.

A flexible ridge is formed along a thumb portion of the glove and along an index finger portion of the glove. The flexible ridges hold a removable easy to clean silicone bodily fluid catcher to capture semen during use. The thumb portion of the glove is joined to the index finger portion of the glove to form an orifice for insertion of the penis. When the thumb portion and index finger portion of the glove are joined, the flexible ridge forms a ringed lip around the orifice for holding the bodily fluid catcher. In one embodiment, the openings are formed in at least one of the thumb portion or the index finger portion of the glove to dispense lubricant around the orifice.

The glove may include a pocket for retaining a vibration device to vibrate the glove. A battery pack is positioned on a wrist portion of the glove; and an electrical wire extends between the battery pack and the vibration device to power the vibration device.

The first problem this invention overcomes is the need for a sex toy that caters to the user's exact preferences of touch therapy. The five-fingered full hand glove allows the wearer to be able to fully achieve the perfect grip and therapeutic touch when masturbating.

This invention also overcomes the problem of an un-lubricated sex toy, as the glove includes a self-lubricating device that is built into the glove, keeping the user from dryness and chaffing. The use of a disposable lubrication packet also allows for easy cleanup.

A third problem the glove addresses is that of a semen catching device. The built in catching device allows the user to ejaculate semen into a bodily fluid catcher that attaches to the glove itself. When the user is done using the glove the catcher can easily be taken off the glove and cleaned or discarded for easy cleanup and safe disposal of bodily fluids.

The fourth problem the invention overcomes is the lack of vibrating stimuli when masturbating. With the added accessory of a vibrating device the user has the option to add the vibrating sensation to the sex therapy session.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

FIGS. 1-6 illustrate an embodiment of a glove of the present invention that is a male sex toy in the form of a spandex masturbatory glove 100, in which the palm side 102 is coated with a soft gelatin material simulating the inside of a woman's vagina. The soft gelatin material may be any one of silicone, thermoplastic elastomer gel, or any other suitable gelatin material. The glove 100 is meant to allow the wearer to masturbate with a soft full hand, five-fingered perfect grip.

Figure 1:
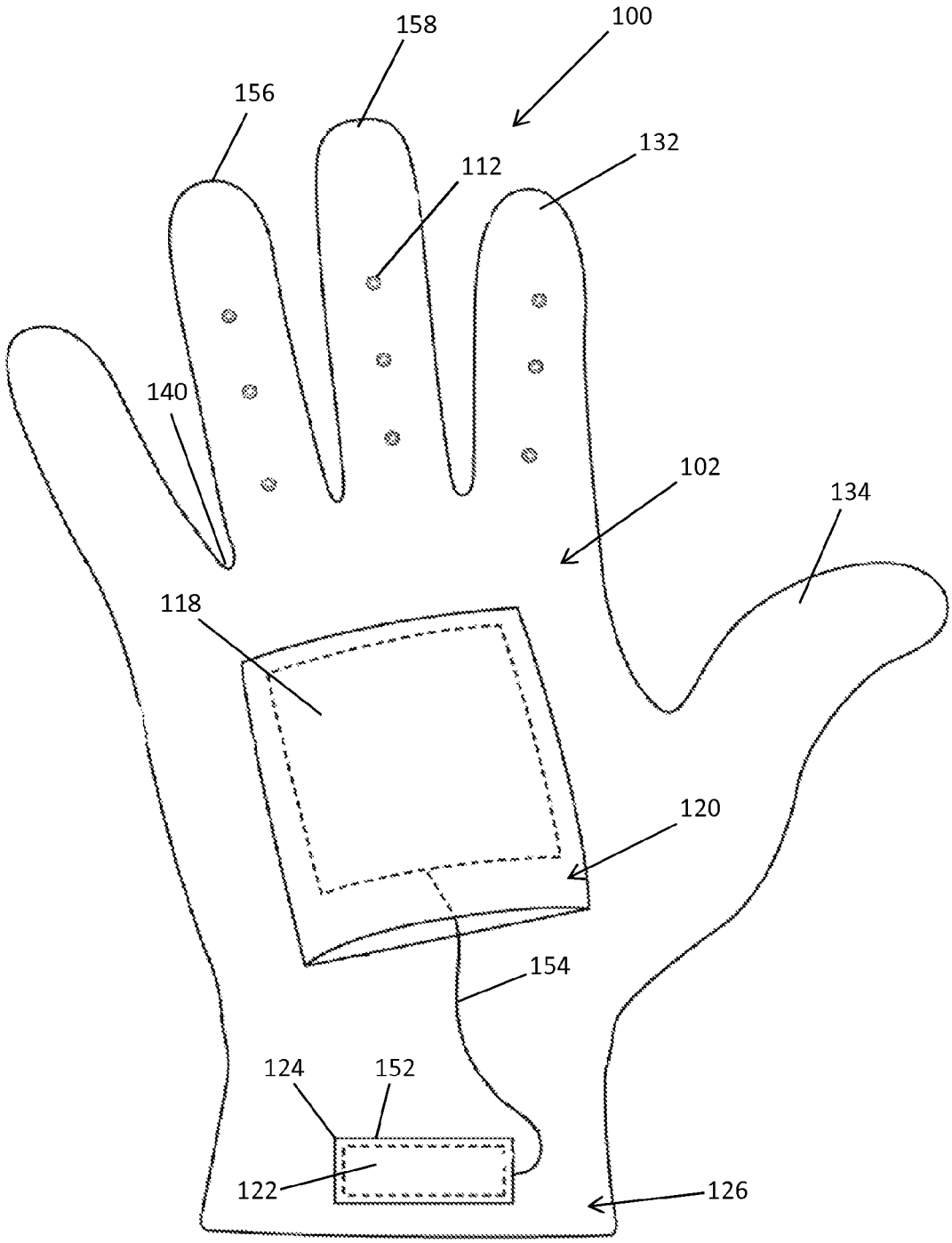
FIG. 1 is a plan view of the palm side of an embodiment of the glove invention.
Figure 2:
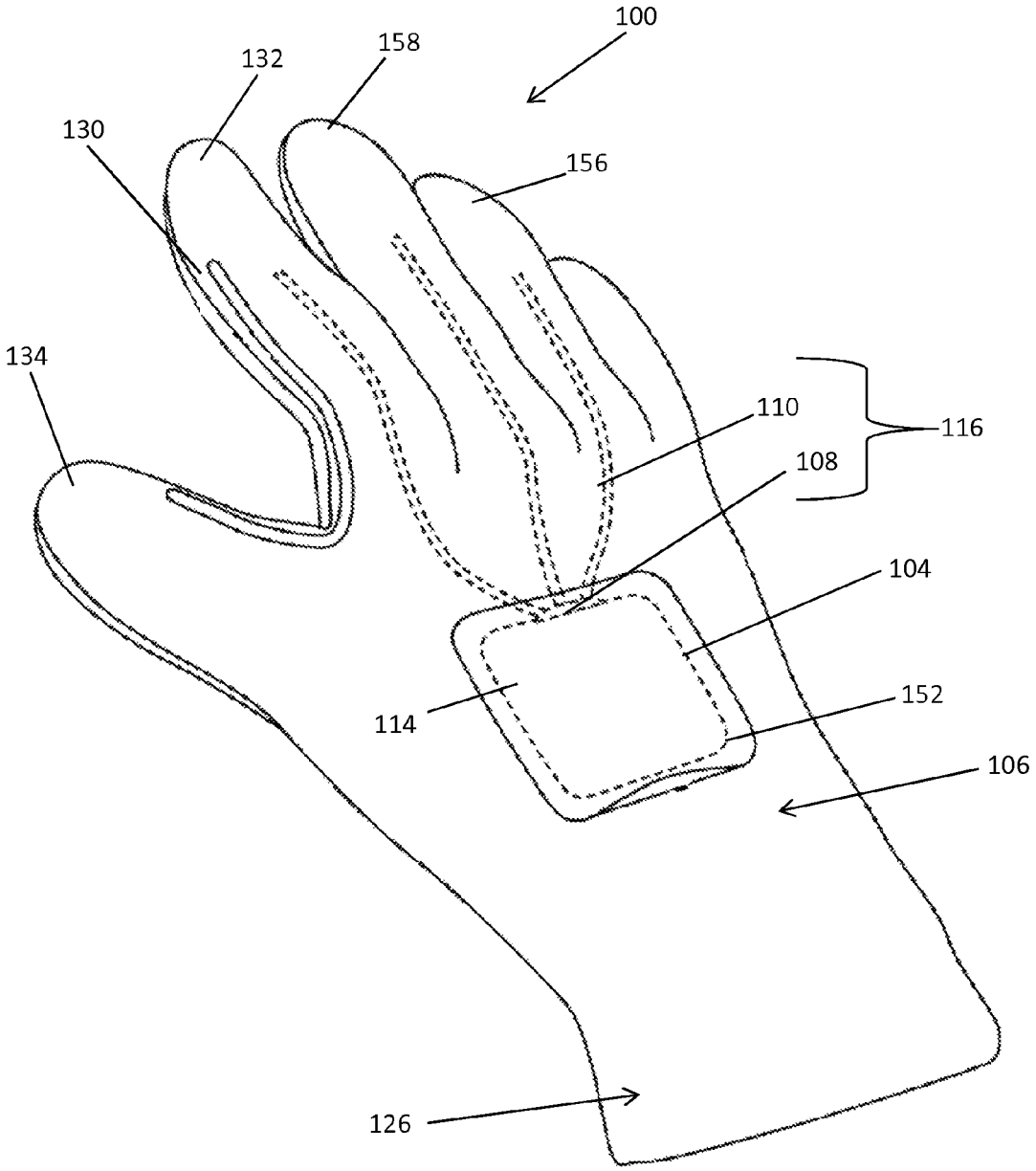
FIG. 2 is an isometric view of the back side of the glove in FIG. 1.
Figure 3:
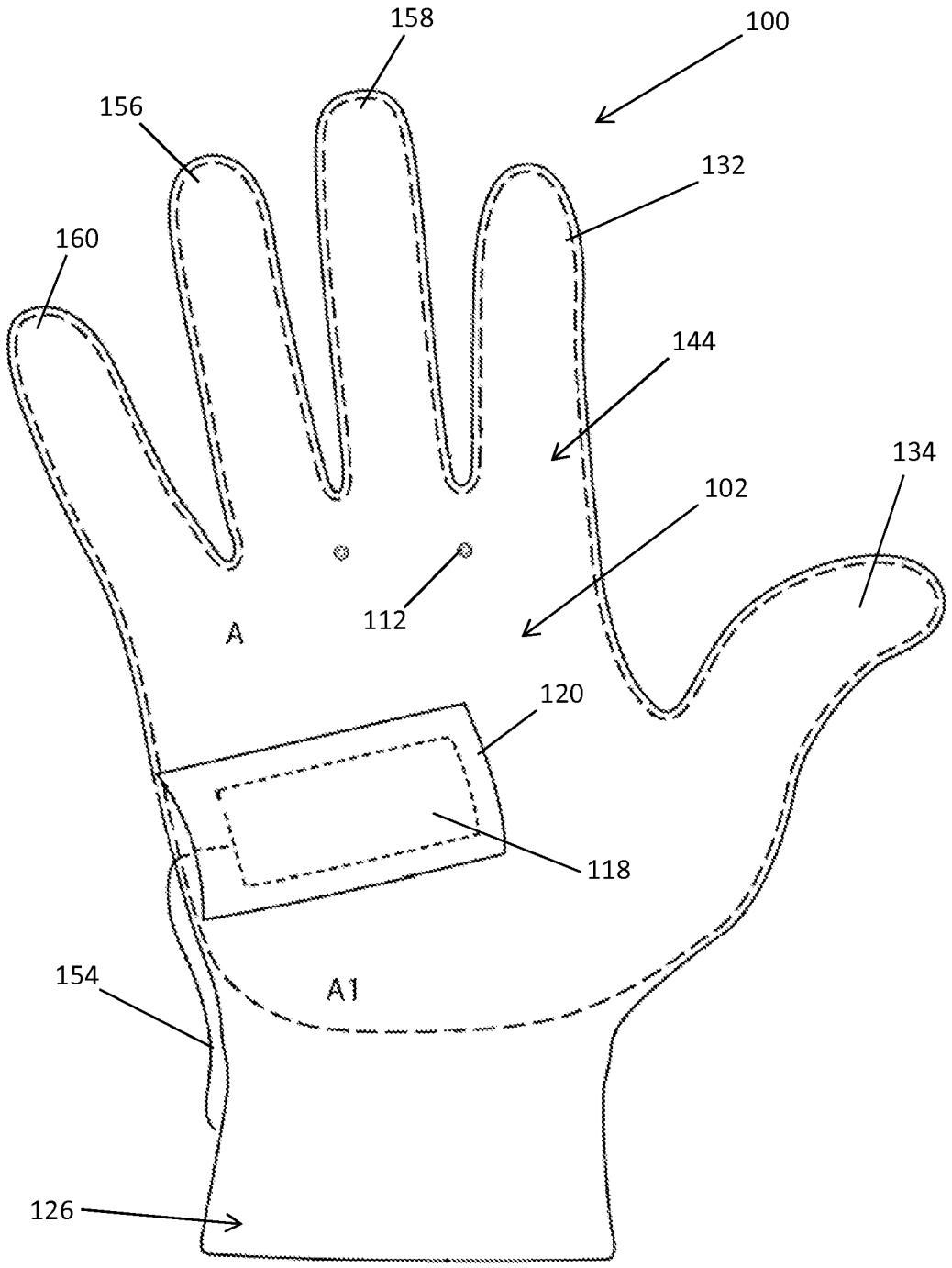
FIG. 3 is a plan view of the palm side of an alternative embodiment of the glove.

An additional feature of the glove 100 is a built in self-lubricating system. A small two-inch square pouch 104 is sewn into the back side 106 of the glove 100. The pouch 104 has a tubing system 116, shown in FIG. 2, that has an open tube attachment 108 that connects to three small rubber tubes 110 that run through the inside lining of the glove 100 to each of the ring finger 156, middle finger 158, and forefinger/index finger 132 and exit through openings 112 in the gelatin fingers 156, 158 and 132, as illustrated in FIG. 1. Alternatively, in FIG. 4, a piercing piece 150 positioned within the pouch 104 connects to two small rubber tubes 110 that run through the inside lining of the glove 100 to between the middle linger 158 to openings 112 formed in the palm side 102 of the glove 100 proximate to the middle finger 158, as illustrated in FIG. 3. More particularly, one opening 112 is formed in the palm side 102 of the glove 100 between the ring finger 156 and the middle finger 158, and another opening 112 is formed in the palm side 102 of the glove 100 between the middle finger 158 and the forefinger 132.

A "Lubrication Packet" 114 is inserted into the backhand pouch 104 connecting to the tubing system 116. When the wearer presses on the pouch 104 it pushes lubrication through the tubing system 116, delivering it to the palm side 102 of the hand through the openings 112. The disposable lubrication packets 114 are filled with enough lubrication for one masturbation session. Lubrication packets 114 are disposable and may be sold separately.

Figure 4:
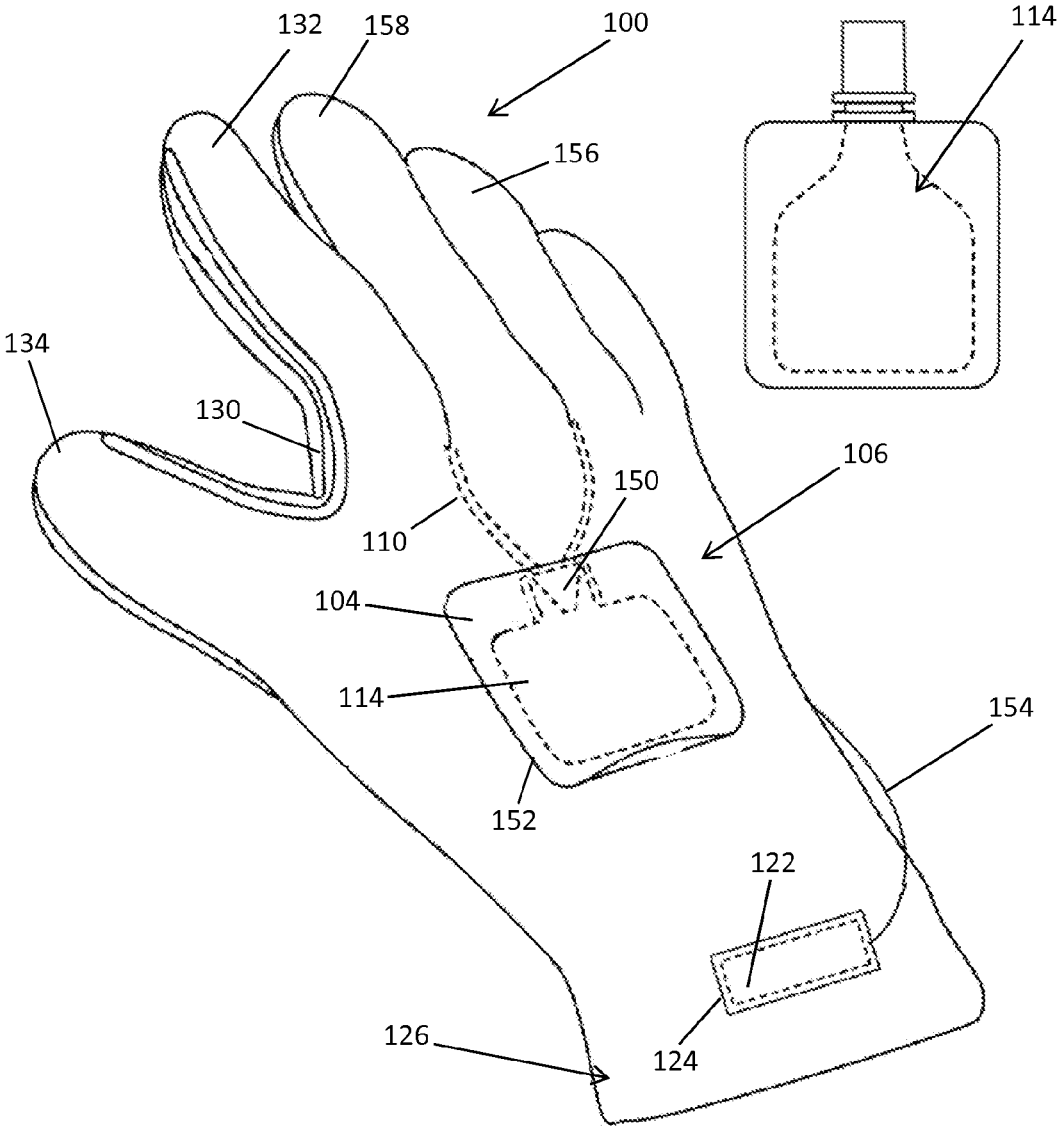
FIG. 4 is an isometric view of the back side of the glove in FIG. 3.
Figure 5:
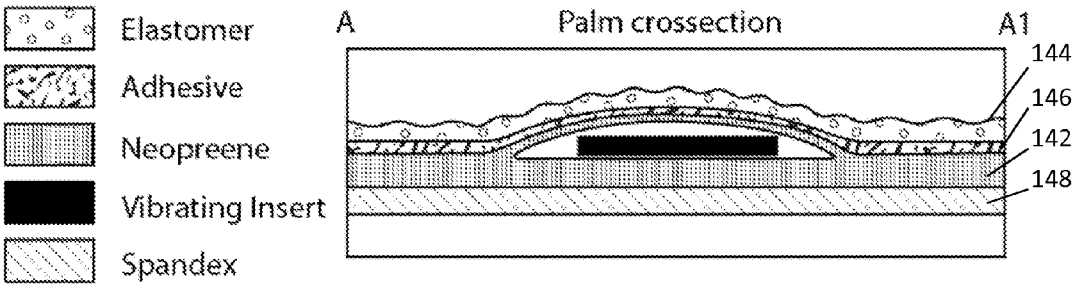
FIG. 5 is a cross-sectional view of the layers of the glove on the palm side.
Figure 6:
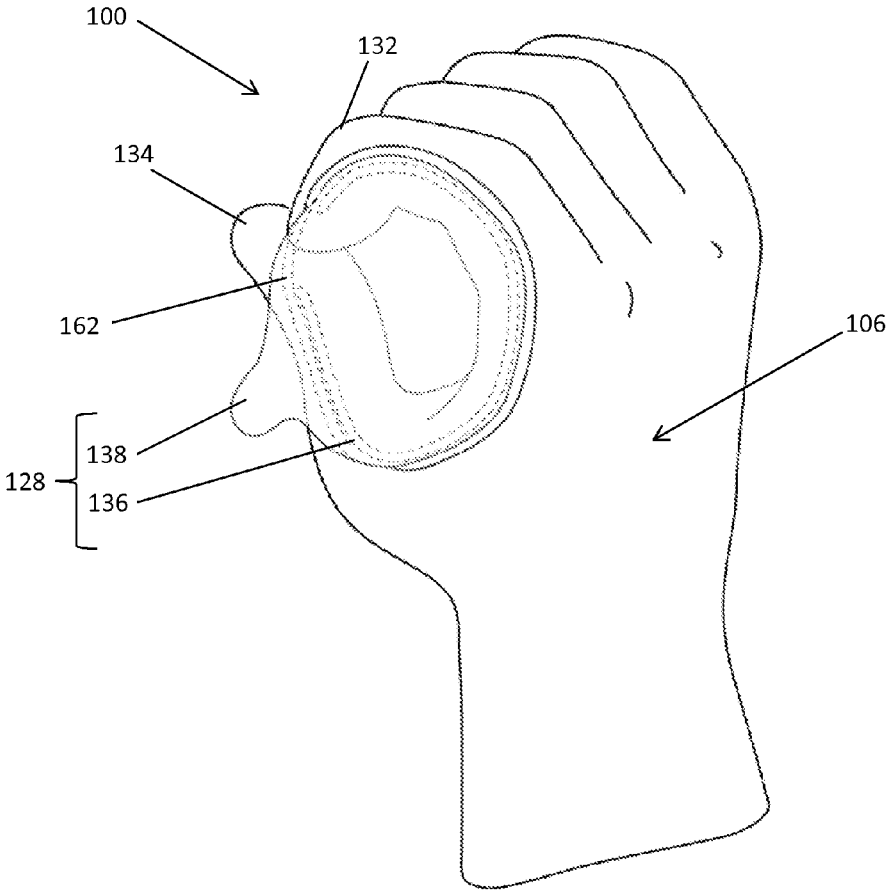
FIG. 6 is an isometric view of the glove with a bodily fluid catcher.

An additional accessory for the glove 100 is a "Vibrating Card" 118 that inserts into a pocket 120 located between the gelatin and the inside palm side 102 of the glove 100, as shown in FIG. 1. The card 118 is the size of a credit card and is wired via and electrical wire 154 to an AAA battery 122 that is stored in an additional battery pocket 124 located on the wrist 126 of the glove 100. In FIG. 1, the battery pocket 124 is located on the palm side 102 of the glove 100. In FIG. 4, the battery pocket 124 is located on the back side 106 of the glove 100. Once switched on, the vibrating card 118 provides a gentle vibration for the user. Vibrating cards 118 may be sold separately.

Another function of the glove 100 is its semen catching system 128 consisting of a plastic ridge 130 that is built along the inner edge of the forefinger 132 and thumb 134 of the glove 100. When the wearer brings the tip of their thumb 134 and forefinger 132 together it creates a ringed lip 136, shown in FIG. 6, which allows the user to wrap a removable silicone bodily fluid catcher 138 around the ridge 130. The bodily fluid catcher 138 may be easily removed from the glove 100, cleaned and reused. Alternatively, the bodily fluid catcher 138 may be disposable after masturbating. Accordingly, disposable bodily fluid catchers 138 may be sold separately from the glove. Additionally, the ringed lip 136 may be configured to retain standard condoms sold separately from the glove 100.

An optional accessory, sold separately is a compact carrying case (not shown) that holds the glove 100, vibrating card 118, bodily fluid catcher 138, lubrication packets 114 and wet wipes (not shown).

The major component of the invention is the glove 100 itself, which is made of light stretchable and comfortable spandex 148. The glove 100 has heavy duty stretch panels 140 between fingers for comfort and ventilation. The material on the wrist 126, as well as the back side 106 of the fingers and hand, consists of a thicker, yet stretchable and breathable spandex 148.

The palm side 102 of the glove itself may be made of a durable and thicker neoprene 142. Layered on top of the neoprene 142 on the palm side 102 of the glove 100 is a half-inch thick Elastomer oil gel coating 144, for example thermoplastic elastomer gel, that extends the full length and width of the palm side 102 of the hand and all five fingers. The Elastomer oil gel 144 attaches to the neoprene palm of the glove 100 with an industrial strength adhesive 146, keeping the spandex glove and the gelatin coating together as one unit. In an alternative embodiment, the glove 100 does not include the neoprene layer 142, but rather, the coating 144 is applied directly to the spandex 148 or applied to the spandex 148 with the adhesive 146. In yet another embodiment, the glove 100 may include a silicone layer attached directly to the glove 100 instead of the coating 144.

The glove 100 has pockets used for containing accessories sold separately. The two pockets 104 and 124 may be made of a durable stainless cotton material 152. The pockets 104 and 124 may be sewn into the glove or the pockets 104 and 124 may be molded into a silicone layer attached to the glove 100. The backhand pocket 104 is used for containing the lubrication packet 114 and the pocket 124 on the wrist 126 is used to hold the AAA battery 122 that powers the vibration device 118.

In the embodiment shown in FIG. 3, along the bottom of the hand just below the little finger 160 is a pocket 120 that extends up into the palm between the Elastomer oil gel 144 and neoprene materials 142. This pocket 120 is for holding the vibrating device 118. The wired AAA battery 122 for this device slips into the pocket 120 on the top of the wrist 126.

In the embodiment shown in FIG. 4, the self-lubrication system begins at the backhand lubrication pocket 104 and is attached to a round plastic piece with a sharp piercing piece 150 used to pierce the lubrication opening allowing for lubrication to be pushed out of the packet 114 and through the self lubrication system contained on the glove 100.

This plastic connection and piercing piece 150 connects to two small thick rubber tubes 110 that are sewn into the backhand 106 of the glove 100 between the spandex 148 and a thin cotton piece of material 152. The two rubber tubes 110 go along the back side 106 of the hand and go along both sides of the middle finger extending to the palm side 102 of the hand just below the fingers exiting through two small holes 112 just below and exiting through the Elastomer oil gel 144 adhered to the palm side 102 of the glove 100.

The rubber "lip" 136 used in the semen catching feature extends the full length of the forefinger and thumb from finger tip to finger tip. The lip 136 may be sewn into or molded into the glove 100. This rubber ridged lip 136 is used to securely hold the bodily fluid catcher 138. The bodily fluid catcher 138 includes a rim 162 that attaches to the lip 136. The rim 162 is sized to easily fit around the lip 136 without stretching or applying excessive force to the bodily fluid catcher 118. The rim 162 attaches to the lip 136 in such a manner that the bodily fluid catcher 118 is easily removed without spilling the bodily fluids therein.

The operation of the invention starts by the user putting the glove 100 on as they would any other glove. Once on, the user would use the glove 100 to masturbate using the soft flesh like Elastomer oil gel or silicone palm. This simulates the sensation of having intercourse with a real vagina. As discussed above, the glove contains a self-lubricating system, which is used to apply lubrication between the penis and Elastomer oil gel palm of the glove 100. This function is used by inserting the accessory lubrication packet 114 into the pocket 104 on the back side 106 of the glove 100. The user would snap in the lubrication packet to the plastic tube that feeds the lubrication system. Once snapped in, the piercing tip 150 of the plastic connecter would pierce the lubrication packet 114 and allow lubrication to flow through the packet 114. The lubrication system of the glove 100 is pressure activated so that when the user presses down on the pocket 104 pushing the lubrication out of the packet 114 and into the tubes 110 that exit through the holes 112 in the palm's Elastomer oil gel 144. The packet 114 is designed to hold enough lubrication for one masturbation session.

The vibration accessory is used by sliding the card 118 into the pocket 120 on the bottom ridge of the glove 100 just below the little finger. Once the card 118 is securely in the pocket 120, the attached battery 122 slides into the wrist pocket 124 on the glove 100. The switch on the battery pack turns on the vibration card 118.

The semen catching function is used when the user brings the tip of their forefinger 132 and thumb 134 together forming a circle. With the other hand the user takes the bodily fluid catcher 138 and wraps it securely around the plastic ridge 130 along the thumb 134 and forefinger 132 of the glove 100. Once the bodily fluid catcher 138 is securely in place the user can ejaculate into it and once finished, squeeze the edge of the bodily fluid catcher 138 to release of the ridge 130 and cleanly and safely remove. The bodily fluid catcher 138 may then be cleaned, for example, using soap and water. In one embodiment, the bodily fluid catcher 138 may be disposed.

FIGS. 7-10 illustrate another embodiment of a glove of the present invention that is a male sex toy in the form of a spandex masturbatory glove 200, having a palm side 202 that is coated with silicone to simulate the inside of a woman's vagina.

Figure 7:
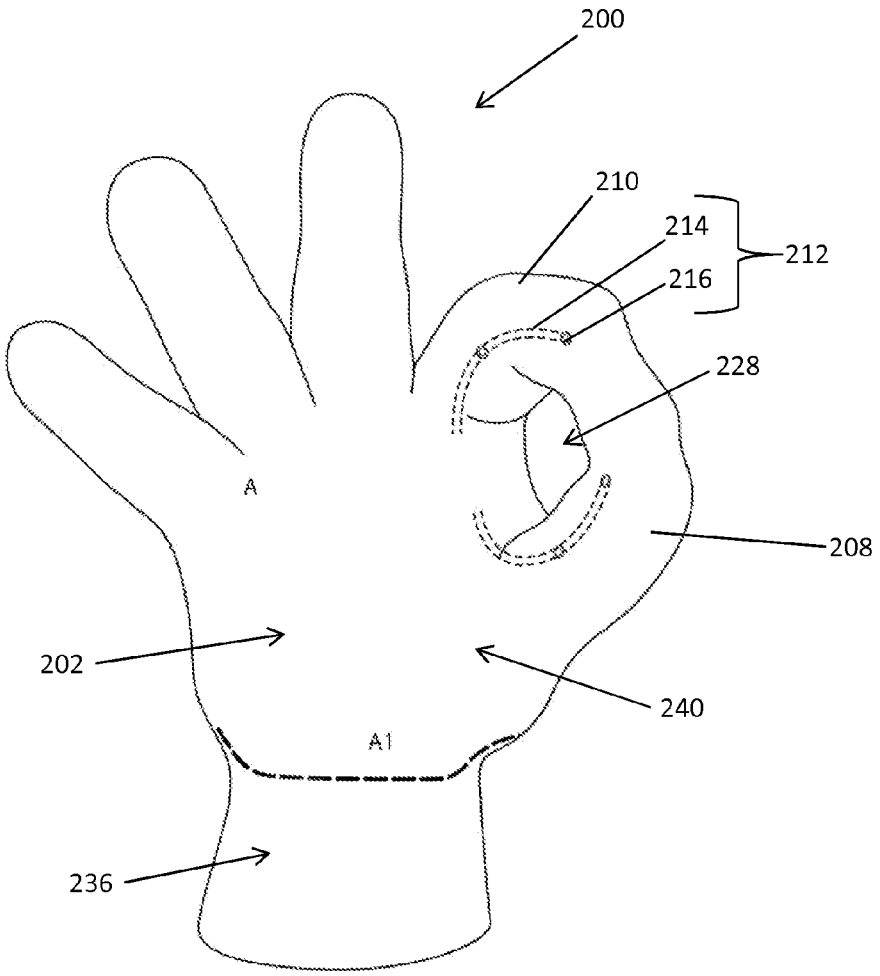
FIG. 7 is a plan view of the palm side of another embodiment of the glove invention.
Figure 8:
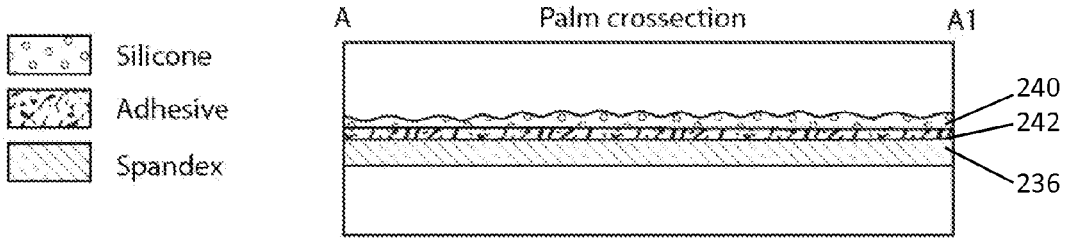
FIG. 8 is a cross-sectional view of the layers of the palm side of the glove in FIG. 7.
Figure 9:
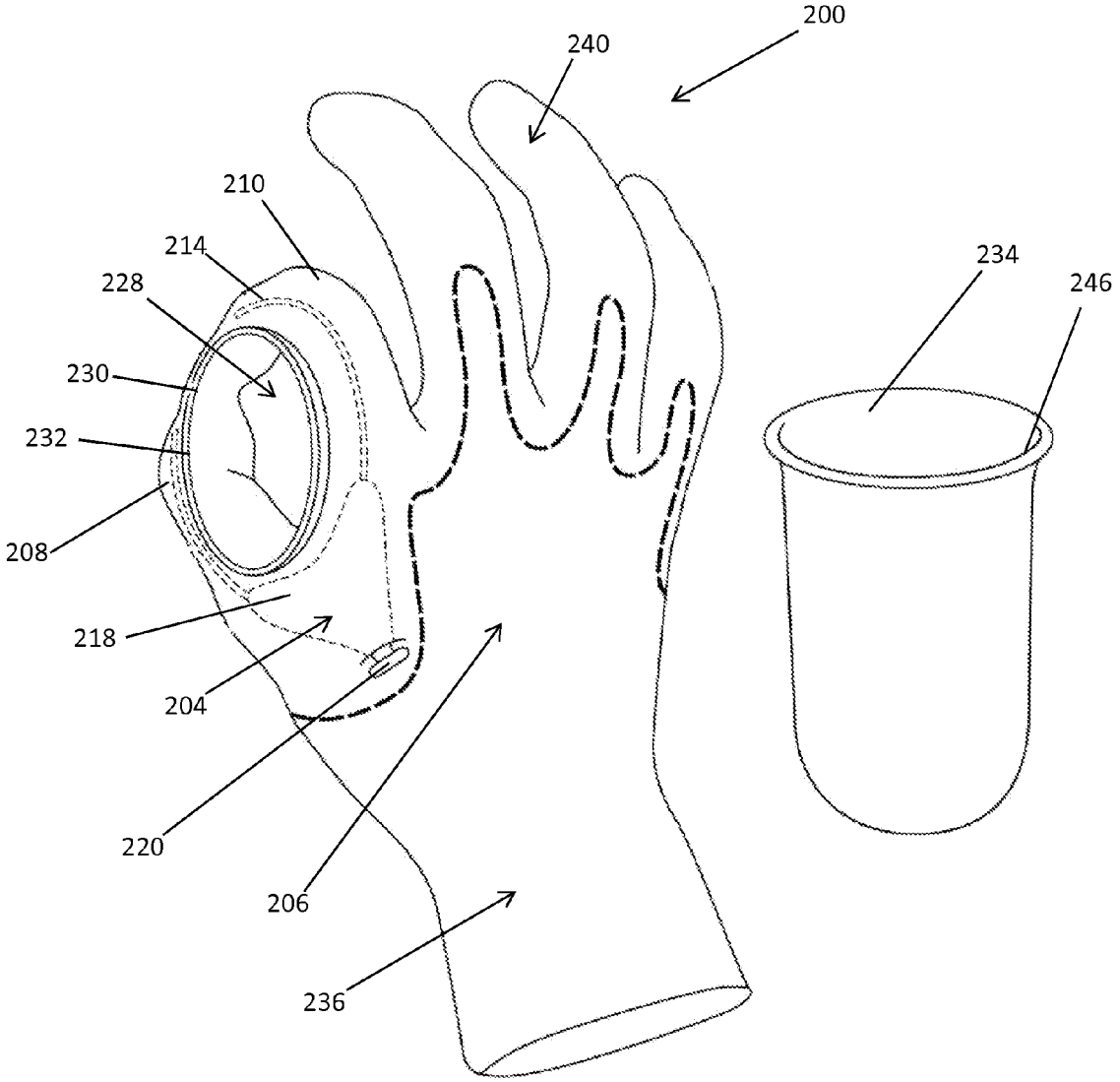
FIG. 9 is an isometric view of the back side of the glove in FIG. 7.

Like the glove 100, the glove 200 includes a built in self-lubricating system having a pouch 204 molded into the glove 200 at the base of the thumb 208 and the forefinger 210. A tubing system 212 includes tubes 214 extending from the pouch 204 and running through the inside lining of the glove 200 to the forefinger 210 and the thumb 208. The tubes 214 exit through openings 216 on the palm side 202 of the glove 200 in the silicone thumb 208 and forefinger 210, as illustrated in FIG. 7.

A bladder 218 is molded into the pouch 204 on the back side 206 of the glove 200 and connected to the tubing system 212. The bladder 218 is in fluid communication with the tubes 214 and includes a plug 220 for receiving lubricant. The bladder 218 may be filled by removing the plug 220 and dispensing lubricant from a lubrication packet or standard lubrication bottle into the bladder 218. The bladder 218 holds enough lubricant for one masturbation session. When the wearer presses on the pouch 204 it pushes lubrication from the bladder 218 through the tubing system 212, delivering it to the thumb 208 and forefinger 210 of the hand through the openings 216.

Figure 10:
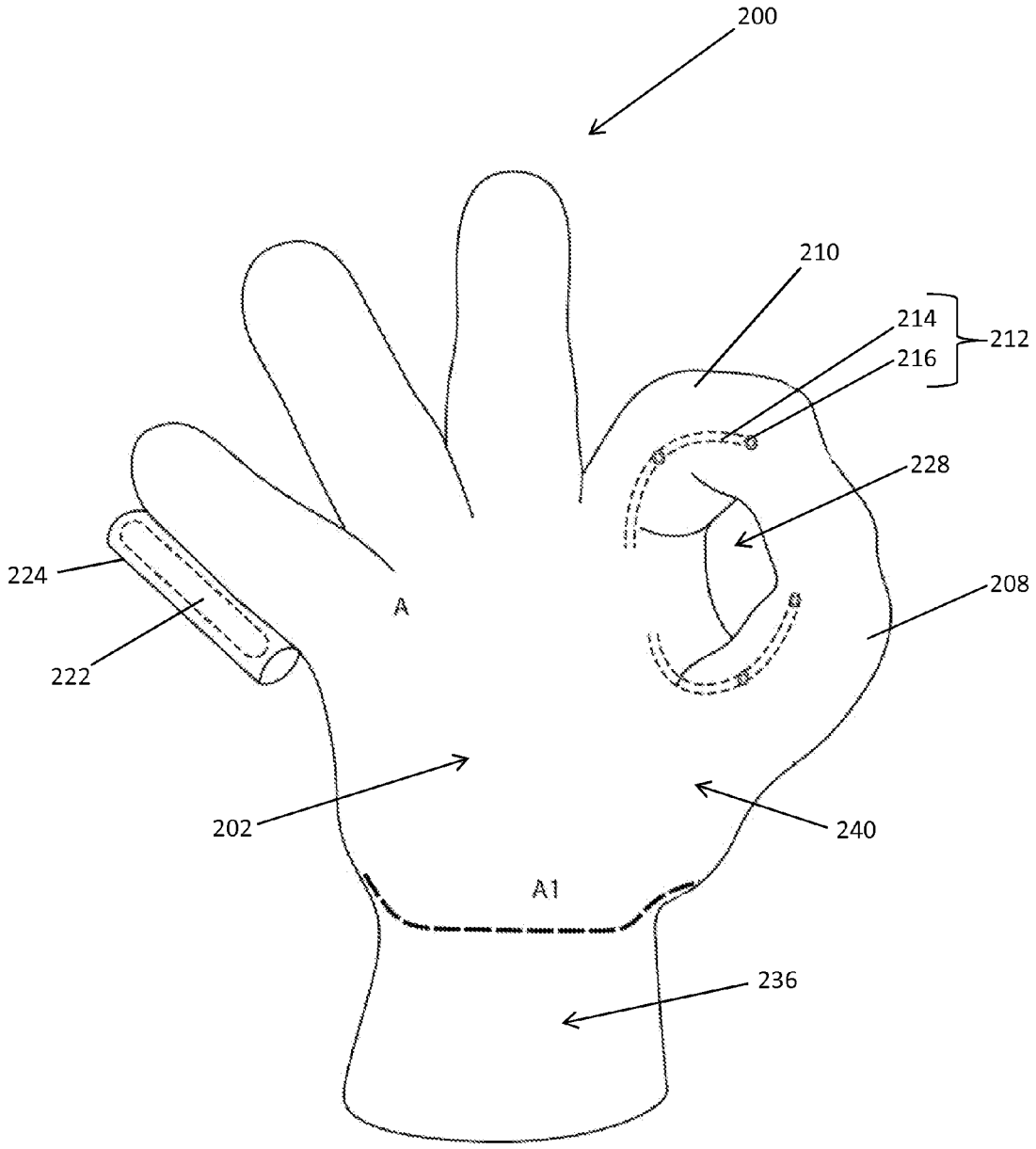
FIG. 10 is a plan view of the palm side of an alternative embodiment of the glove in FIG. 7.

An additional accessory for the glove 200 is a vibrating device 222 that inserts into a pocket 224 attached to the little finger 244 of the glove, as shown in FIG. 10. The vibrating device 222 is a "bullet" shaped vibrator that includes a built in battery. Alternatively, the vibrating device 222 may attach to a battery retained in the wrist of the glove, as shown in the embodiment of the glove 100. In one embodiment, for example the embodiment shown in FIG. 7, the glove 200 does not include the vibrating device 222 or the pocket 224. Once switched on, the vibrating device 222 provides a gentle vibration for the user. The vibrating device 222 may be sold separately or included with the glove 200.

Another function of the glove 200 is its semen catching system. The thumb 208 and forefinger 210 of the glove 200 are joined together to form an orifice 228. During use, the penis is inserted through the orifice 228. A plastic ridge 230 that is built along the inner edge of the forefinger 210 and thumb 208 creates a ringed lip 232 around the orifice 228, shown in FIG. 9, that allows the user to wrap a removable silicone bodily fluid catcher 234 around the ridge 230. The bodily fluid catcher 234 includes a rim 246 that attaches to the ridge 230. The rim 246 is sized to easily fit around the ridge 230 without stretching or applying excessive force to the bodily fluid catcher 234. The rim 246 attaches to the ridge 230 in such a manner that the bodily fluid catcher 234 is easily removed without spilling the bodily fluids therein. The bodily fluid catcher 234 may be removed from the glove 200, cleaned and reused. Alternatively, the bodily fluid catcher 234 may be disposable after masturbating. Accordingly, disposable bodily fluid catchers 234 may be sold separately from the glove. Additionally, although the bodily fluid catcher 234 is preferred, the ringed lip 232 may be configured to retain standard condoms sold separately from the glove 200.

The glove 200 is made of light stretchable and comfortable spandex 236 and may include heavy duty stretch panels between fingers for comfort and ventilation. The palm side 202 of the glove 200 is layered with silicon 240 that is attached to the spandex 236 with an industrial strength adhesive 242, keeping the spandex 236 and the silicon 240 together as one unit.

The end result of the invention is to give the wearer a pleasurable sex therapy masturbation session. The user will have all of the functionality that has never been offered in any one male sex toy. They can experience a fleshy vagina like surface as well as vibration to maximize the sensation.

The self-lubrication system will keep the user focused on the therapy instead of always reaching for more lubrication, which creates a potential mess and takes away from the sexual therapy experience.

The semen catcher makes for a cleaner and safer session that allows the user to contain their bodily fluids in the catching device and discard.

By efficiently integrating all of the necessary and desired elements that make masturbating its upmost pleasurable into one self-contained glove, the present invention solves the problems that remain with the other products currently on the market as well as the other devices that have been documented in patents through the years. With the use of its soft flesh-like palm the user can simulate the texture and sensation of a real vagina. The use of a five-fingered glove allows the user to achieve the perfect grip that they have become accustomed to over the years they have been masturbating. This cannot be achieved by a one-size-fits-all tube that may be too small or too big for the wearer to truly enjoy. The self-lubricating mechanism of the invention allows the user to focus on the task at hand and not have to always be reaching for messy lube bottles and creating a mess in the general area. The self-lubricating mechanism is clean and allows the user to distribute the perfect amount of lubrication. The semen catching mechanism allows the user to easily dispose of bodily fluids in a contained unit. Other products on the market do not have any clean and safe way to not only catch semen, but also cleanly dispose of it after masturbating. Other products may offer vibration, but a vibrating egg that rests at the tip of the product and only vibrates the tip of the penis achieves this. The glove allows the user to have a vibrating sensation along the full palm of the wearer, thus giving a vibrating sensation along the full shaft of the penis and the scrotum.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. The components illustrated are not limited to the specific embodiments described herein, but rather, components of the system may be utilized independently and separately from other components described herein. Thus, the breadth and scope of the present invention should not be limited by any of the above-described exemplary embodiments, but should be defined only in accordance with the following claims appended hereto and their equivalents.

In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A masturbatory sex toy, comprising:

a glove with a palm side and a back side, wherein said glove further comprises a flexible ridge formed along a thumb portion of said glove and an index finger portion of said glove, wherein said thumb portion of said glove and said index finger portion of said glove are joined, and wherein said flexible ridge forms a ringed lip;

at least one opening on said palm side of said glove;

a bodily fluid catcher held in contact with said glove by said ringed lip; and a pouch in fluid communication with said at least one opening.

2. The masturbatory sex toy of claim 1, wherein said palm side of said glove comprises a spandex layer and at least one of a silicone layer and an elastomeric gel layer secured to said spandex layer.

3. The masturbatory sex toy of claim 1, wherein the palm side of said glove comprises a silicone layer having a textured outer surface, wherein said textured outer surface simulates a fleshy vagina.

4. The masturbatory sex toy of claim 1, wherein said pouch is formed between layers of material of said glove and wherein said pouch holds a lubricant that is dispensed through said at least one opening onto said palm side of said glove.

5. The masturbatory sex toy of claim 1 further comprising a bladder retained in said pouch, said bladder in fluid communication with said at least one opening and having a plug for inserting lubricant therein.

6. The masturbatory sex toy of claim 1 further comprising a pocket on at least one of said palm side of said glove or a little finger of said glove, and a vibration device within said pocket.

7. The masturbatory sex toy of claim 1 further comprising a tube between said pouch and said at least one opening.

8. The masturbatory sex toy of claim 7, wherein said pouch is on said back side of said glove and said tube extends to said at least one opening on said palm side of said glove.

9. The masturbatory sex toy of claim 1, further comprising at least one additional opening on said palm side of said glove, wherein said openings are located in at least one of said thumb portion of said glove or said index finger portion of said glove, wherein said openings are in fluid communication with said pouch.

10. The masturbatory sex toy of claim 1, further comprising a lubrication packet within said pouch.

11. The masturbatory sex toy of claim 1, wherein a first base section and a first distal end of said thumb portion of said glove is permanently joined to a second base section and a second distal end of said index finger portion of said glove to form an orifice, and said at least one opening is formed in at least one of said thumb portion of said glove or said index finger portion of said glove.

12. A masturbatory sex toy, comprising:

a glove with a palm side and a back side, wherein a thumb portion of said glove is permanently joined to an index finger portion of said glove to form an orifice;

a plurality of openings on said palm side of said glove;

a pouch in fluid communication with said openings, wherein said pouch holds a lubricant and is pressure activated to dispense said lubricant through said openings onto said palm side of said glove; and a flexible ridge formed along said thumb portion of said glove and said index finger portion of said glove, wherein said flexible ridge holds a bodily fluid catcher, wherein said flexible ridge forms a ringed lip around said orifice and said bodily fluid catcher is joined to said ringed lip.

13. The masturbatory sex toy of claim 12, further comprising:

a plurality of tubes extending between said pouch and said openings, wherein said pouch is on said back side of said glove and said tubes extend to said openings on said palm side of said glove;

a pocket on at least one of said palm side of said glove or a little finger of said glove; and a vibration device within said pocket.

14. The masturbatory sex toy of claim 12, further comprising a lubrication packet within said pouch.

15. The masturbatory sex toy of claim 12, wherein said openings are formed in at least one of said thumb portion of said glove or said index finger portion of said glove.

16. A masturbatory sex toy, comprising:

a glove with a palm side and a back side;

a flexible ridge formed along a thumb portion of said glove and an index finger portion of said glove, wherein a first distal end of said thumb portion joins a second distal end of said index finger portion to form an orifice; and a bodily fluid catcher having a rim sized to fit around said flexible ridge, wherein said rim of said bodily fluid catcher engages said flexible ridge around a periphery of said orifice formed by said thumb portion and said index finger portion of said glove, and wherein said bodily fluid catcher extends from said flexible ridge and extends away from said palm side of said glove.

17. The masturbatory sex toy of claim 16, further comprising a plurality of openings on said palm side of said glove, and a pouch in fluid communication with said openings, wherein said pouch holds a lubricant and is pressure activated to dispense said lubricant through said openings onto said palm side of said glove.

18. A masturbatory sex toy, comprising:

a glove comprising a palm side, a back side, at least one individual finger segment, a plurality of additional finger segments, and a thumb segment, wherein said at least one individual finger segment has a first base portion and a first distal end, said plurality of additional finger segments each having a second base portion and a second distal end and said thumb segment having a third base portion and a third distal end; and a first connection between said at least one individual finger segment and said thumb segment at said first base portion and said third base portion, respectively, and a second connection between said at least one individual finger segment and said thumb segment toward said first distal end and said third distal end and forming an orifice to said palm side, and a plurality of connections between said additional finger segments, wherein said plurality of connections are at said second base portion without any other connection between said additional finger segments from said second base portion to said second distal end, wherein said orifice and said palm side of said glove comprise a soft, flexible outer surface, and wherein said second connection is through at least one of a fixed joint connecting said at least one individual finger segment and said thumb segment and a bodily fluid catcher extending between said at least one individual finger segment and said thumb segment.

19. The masturbatory sex toy of claim 18, further comprising a plurality of openings on said palm side of said glove and a lubrication pouch in fluid communication with said openings.

20. The masturbatory sex toy of claim 19, further comprising a vibrator holder, wherein said vibrator holder is attached to at least one of said finger segments, and wherein said bodily fluid catcher is connected to said at least one individual finger segment and said thumb segment around a periphery of said orifice and extends from said orifice in an elongated manner.

21. The masturbatory sex toy of claim 20, wherein at least one of said palm side of said glove, said bodily fluid catcher, said at least one individual finger segment, and said thumb segment is comprised of silicone, and wherein said vibrator holder is a pocket attached to a pinky finger segment.

22. The masturbatory sex toy of claim 21, wherein said silicone further comprises a textured surface, wherein said silicone textured surface simulates a fleshy vagina and wherein said at least one individual finger segment comprises an index finger segment.

23. A masturbatory sex toy, comprising:

a glove comprising a palm side, a back side, at least one individual finger segment, a plurality of additional finger segments, and a thumb segment, wherein said at least one individual finger segment has a first base portion and a first distal end, said plurality of additional finger segments each have a second base portion and second distal end and said thumb segment has a third base portion and third distal end;

a first connection between said at least one individual finger segment and said thumb segment at said first base portion and said third base portion, respectively, and a second connection between said at least one individual finger segment and said thumb segment toward said first distal end and said third distal end and forming an orifice to said palm side, and a plurality of connections between said additional finger segments, wherein said plurality of connections are at said second base portion without any other connection between said additional finger segments from said second base portion to said second distal end; and a plurality of openings on said palm side of said glove and a lubrication pouch in fluid communication with said openings.

24. A masturbatory sex toy, comprising:

a glove comprising a palm section, a back section, a plurality of finger segments, and a thumb segment, wherein said plurality of finger segments includes an index finger segment, and wherein said index finger segment and said thumb segment each has a base portion and a distal end;

a vibrator holder attached to at least one of said finger segments;

a fixed connection between said index finger segment and said thumb segment, wherein said fixed connection joins said distal end of said index finger segment to said distal end of said thumb segment, and wherein said fixed connection forms an orifice to said palm section of said glove; and a bodily fluid catcher, wherein said bodily fluid catcher is connected to said glove around said orifice and extends from said orifice in an elongated manner, and wherein at least one of said palm section of said glove, said bodily fluid catcher, said index finger segment, and said thumb segment is comprised of silicone.

25. The masturbatory sex toy of claim 24, wherein said vibrator holder is further comprised of a pocket attached to at least one of said plurality of finger segments.

26. The masturbatory sex toy of claim 25, wherein another one of said plurality of finger segments is comprised of a pinky finger segment, and wherein said pocket is attached to said pinky finger segment on a side of said pinky finger facing away from at least one of said index finger segment and said palm section.

27. The masturbatory sex toy of claim 26, wherein said silicone further comprises a textured outer surface, and wherein said textured outer surface simulates a fleshy vagina.

28. The masturbatory sex toy of claim 24, further comprising a plurality of openings on said palm section of said glove and a lubrication pouch in fluid communication with said openings.

29. A masturbatory sex toy, comprising:

a glove comprising a palm section, a back section, a plurality of finger segments and a thumb segment, wherein said plurality of finger segments comprises an index finger segment and at least one additional finger segment, wherein said glove further comprises a fixed connection between said index finger segment and said thumb segment, and wherein said fixed connection forms an orifice to said palm section of said glove;

a bodily fluid catcher connected to said glove proximate to said at least one additional finger segment and said thumb segment, wherein said bodily fluid catcher extends in an elongated manner from said at least one finger segment and said thumb segment and extends away from said palm section, and wherein said bodily fluid catcher is connected to said glove around said orifice; and a vibrator holder attached to said glove, wherein at least one of said palm section of said glove, said bodily fluid catcher, said plurality of finger segments, said thumb segment, and said vibrator holder is comprised of silicone having a textured outer surface.

30. The masturbatory sex toy of claim 29, further comprising a flexible ridge extending from said at least one additional finger segment to said thumb segment, wherein said bodily fluid catcher is further comprised of a rim sized to fit around said flexible ridge when a first tip portion of said at least one additional finger segment is brought together with a second tip portion of said thumb segment and said at least one additional finger segment and said thumb segment form a substantially circular shape corresponding with said rim of said bodily fluid catcher.

31. The masturbatory sex toy of claim 29, wherein said vibrator holder is comprised of a tubular holder attached to at least one of said plurality of finger segments or said thumb segment and is shaped for holding a bullet-shaped vibrator, wherein said vibrator holder has a longitudinal axis aligned with at least one of said plurality of finger segments and said thumb segment to which said vibrator holder is attached, and wherein said textured outer surface simulates a fleshy vagina.

32. The masturbatory sex toy of claim 29, further comprising a plurality of openings on said palm section of said glove and a lubrication pouch in fluid communication with said openings.

* * * * *